US006189241B1

(12) United States Patent
Liu

(10) Patent No.: US 6,189,241 B1
(45) Date of Patent: Feb. 20, 2001

(54) CUSHIONED IN-LINE SKATE SHOE

(75) Inventor: Peter S. P. Liu, Taipei (TW)

(73) Assignee: European Sports Enterprise Co., Ltd. (TW)

( * ) Notice: Under 35 U.S.C. 154(b), the term of this patent shall be extended for 0 days.

(21) Appl. No.: 09/506,469

(22) Filed: Feb. 17, 2000

(51) Int. Cl.[7] ..... A43B 5/04; A43B 13/20; A43B 7/06

(52) U.S. Cl. ..... 36/115; 36/117.1; 36/3 B; 36/29; 36/43

(58) Field of Search ..... 36/115, 116, 117.1, 36/117.2, 117.5, 3 B, 43, 44, 100, 101, 29

(56) References Cited

U.S. PATENT DOCUMENTS 4,271,606 * 6/1981 Rudy ..... 36/29
4,274,211 * 6/1981 Funck ..... 36/3 B
4,670,995 * 6/1987 Huang ..... 36/3 B
4,774,774 * 10/1988 Allen, Jr. ..... 36/29
5,477,626 * 12/1995 Kwon ..... 36/3 B
5,528,841 * 6/1996 Pozzobon ..... 36/115
5,878,513 * 3/1999 Annovi et al. ..... 36/115
5,947,487 * 9/1999 Keleny et al. ..... 36/115
6,050,574 * 4/2000 Olson et al. ..... 36/115
6,098,313 * 8/2000 Skaja ..... 36/29

* cited by examiner

*Primary Examiner*—Paul T. Sewell
*Assistant Examiner*—Anthony Stashick
(74) *Attorney, Agent, or Firm*—Ladas and Parry

(57) ABSTRACT

A cushioned in-line skate shoe comprises: an in-line skate shoe body, including: an outer side wall which has an outer lower edge, an inner side wall which has an inner lower edge, a sole provided on a bottom of the shoe body and connected between the outer and inner lower edges, at least one outer hole and at least one inner hole formed on the outer lower edge and the inner lower edge, respectively; an air cushion foot pad including: an upper surface, a lower surface opposing to the upper surface, a circumferential edge which is formed between the upper and lower surfaces, a plurality of flexible columns connecting the upper surface and the lower surface to define a plurality of air chambers formed within the circumferential edge so as to rigidly support the air chambers, a plurality of transverse protrusions formed on the circumferential edge of the foot pad, thereby when the foot pad is positioned over and contact with the sole of the shoe body, the protrusions are inserted into the outer and inner holes of the shoe body to secure the foot pad within the shoe body.

5 Claims, 5 Drawing Sheets

CUSHIONED IN-LINE SKATE SHOE

FIELD OF THE INVENTION

The present invention relates to a cushioned in-line skate shoe having a separable air cushion foot pad which can cushion and absorb shocks, and can selectably adjust the inclined angle thereof so as to enhance the comfort and controllability of the in-line skate during roller skating.

BACKGROUND OF THE INVENTION

Conventionally, to have the comfort of wearing an in-line skate, a rubber foot pad is adhered to the insole of the in-line skate shoe body by adhesive. However, since roller skating comprises motions such as leaping, pivoting and serpentine, and the in-line skate shoe body is usually made of hard materials and covers a wearer's ankle to block the wearer from pivoting the ankle to reduce the shocks in roller skating, the conventional rubber foot pad cannot provide a sufficient shock absorbing function. Therefore, the legs and the feet of the wearer are usually uncomfortable and are even injured.

Further, after using for a period of time, due to the wearer's weight acting thereon, the rubber foot pad deforms permanently and can no longer achieve the desired cushioning and shock absorbing functions. In addition, after long time use, the adhesive hardens and loses its intended function such that the foot pad separates from the shoe body and is displaced, whereby the foot pad not only doesn't have the functions of cushioning and absorbing shocks, it even prevents the wearer from wearing the in-line skates.

In addition to the rubber foot pad, a conventional air cushion foot pad is used. As shown in FIGS. 1 and 2, the conventional air cushion foot pad is generally a hollow and closed foot pad, which utilizes the air pressure within the foot pad to provide the effect of resilient support. Moreover, the thickness of the pad is substantially the same and no support is provided within the pad. Therefore, while wearing the in-line skate, the air cushion foot pad is pressed and deformed under the wearer's weight and even the upper surface of the foot pad contacts with the lower surface thereof. Consequently, the desired cushioning and shock absorbing functions cannot be obtained.

Further, if the air cushion foot pad is pierced or worn out, air within the foot pad will leak out and the pad will no longer provide resilient support. The conventional air cushion foot pad also has the problem of easily separating from the in-line skate shoe body.

Moreover, to meet the ergonomic requirements, the sole of a conventional in-line skate shoe is generally made so that it inclines slightly forward; or, when viewed horizontally, the heel portion 90 of the sole is slightly higher than the toe portion 80 thereof (see FIG. 3). Conventionally, the heel portion 90 of the sole is made slightly thicker than the toe portion 80 thereof, or the sole of the in-line skate shoe is attached to the wheels in a predetermined angle, so as to obtain a forward inclined configuration which makes wearing the in-line skate comfortable and meets the ergonomic requirements. However, since the above inclined configuration is predetermined and cannot be easily changed due to the cost of designing, manufacturing and marketing, it does not meet some users' specific requirements (such as a larger inclined angle or no inclined angle).

SUMMARY OF THE INVENTION

To overcome the above disadvantages, it is an objective of the present invention to provide a cushioned in-line skate shoe having a separable air cushion foot pad, wherein the foot pad can cushion and absorb shocks such that roller skating is more comfortable and injury can be avoided.

It is another objective of the present invention to provide a cushioned in-line skate shoe having a separable air cushion foot pad, wherein the foot pad can be firmly secured to the in-line skate shoe body.

It is the other objective of the present invention to provide a cushioned in-line skate shoe having a separable air cushion foot pad, wherein a heel portion of the foot pad is thicker than a toe portion of the foot pad such that the sole of the in-line skate shoe body does not have to be made in an inclined configuration. In addition, a variety of foot pads with different thickness differences between the toe portion and the heel portion can be selected by the wearer so as to adjust the inclined angle of the in-line skate shoe.

It is a further objective of the present invention to provide a cushioned in-line skate shoe having a separable air cushion foot pad, wherein a plurality of flexible columns are formed between the upper surface and the lower surface of the foot pad so as to maintain the appropriate support and rigidity of the foot pad.

To achieve these objectives, the cushioned in-line skate shoe in accordance with the present invention comprises: an in-line skate shoe body, including: an outer side wall which has an outer lower edge, an inner side wall which has an inner lower edge, a sole provided on a bottom of the shoe body and connected between the outer and inner lower edges, at least one outer hole and at least one inner hole formed on the outer lower edge and the inner lower edge, respectively; an air cushion foot pad including: an upper surface, a lower surface opposing to the upper surface, a circumferential edge which is formed between the upper and lower surfaces, a plurality of flexible columns connecting the upper surface and the lower surface to define a plurality of air chambers formed within the circumferential edge so as to rigidly support the air chambers, a plurality of transverse protrusions formed on the circumferential edge of the foot pad, thereby when the foot pad is positioned over and contact with the sole of the shoe body, the protrusions are inserted into the outer and inner holes of the shoe body to secure the foot pad within the shoe body.

The structure and objectives of the present invention will be more readily understood by those skilled in the art from the following description of the preferred embodiments taken in conjunction with the accompanying drawings.

DETAILED DESCRIPTION OF THE PREFERRED EMBODIMENT

Figure 1:
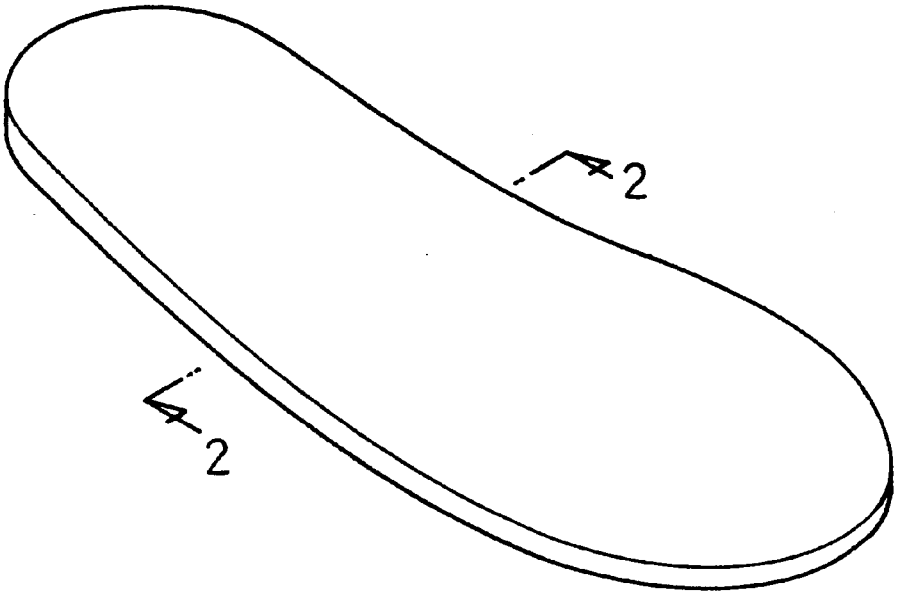
FIG.1 (PRIOR ART)
FIG. 1 is a schematic view of a conventional air cushion foot pad.
Figure 2:
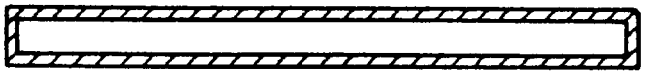
FIG.2 (PRIOR ART)
FIG. 2 is a cross sectional view taken along Line 2—2 of FIG. 1.
Figure 3:
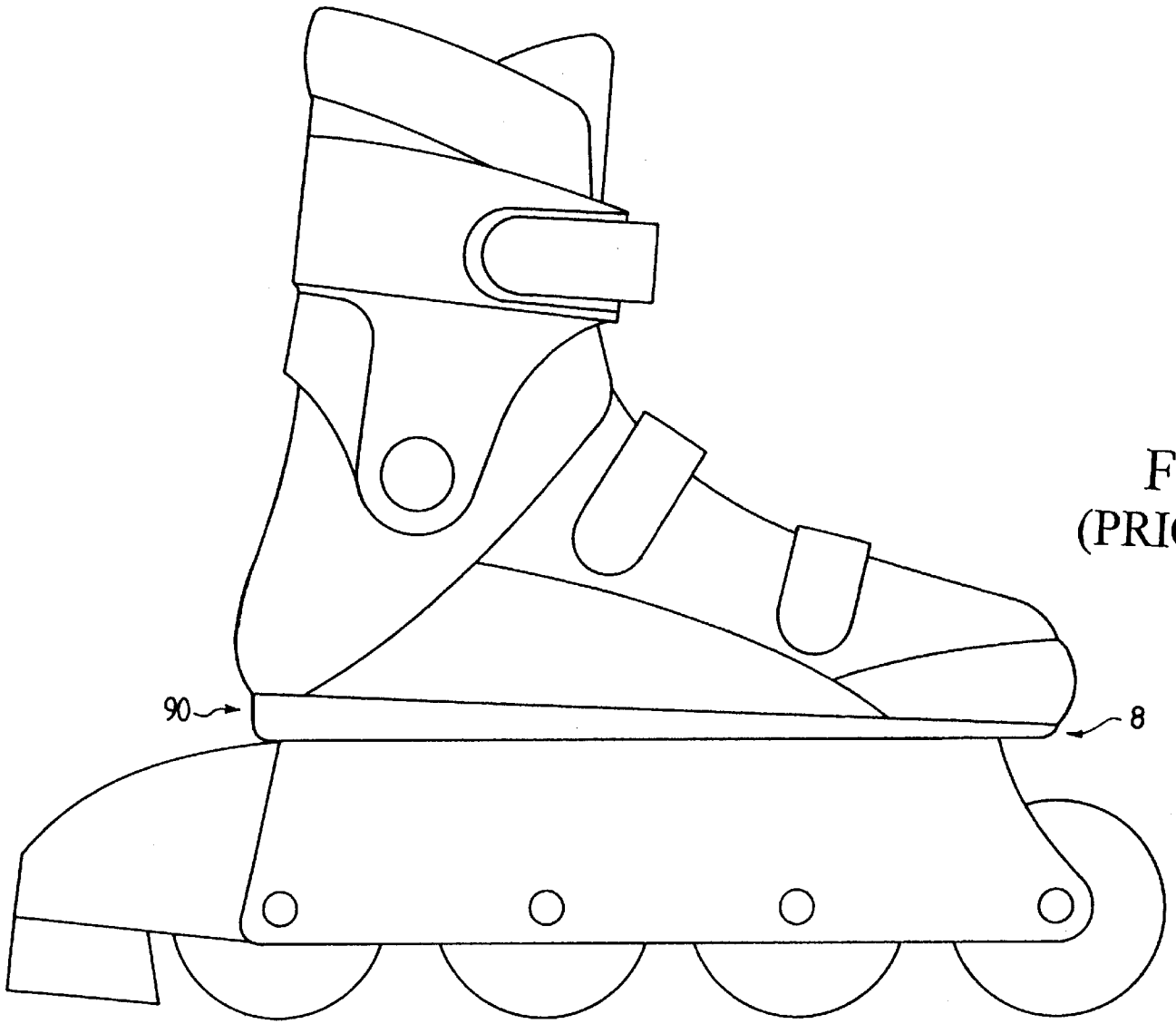
FIG.3 (PRIOR ART)
FIG. 3 is a schematic view showing the outer structure of a conventional in-line skate, wherein the sole of an in-line skate shoe body is made such that the toe portion of the sole is thinner than the heel portion of the sole and the sole is inclined with respect to the wheels.
Figure 4:
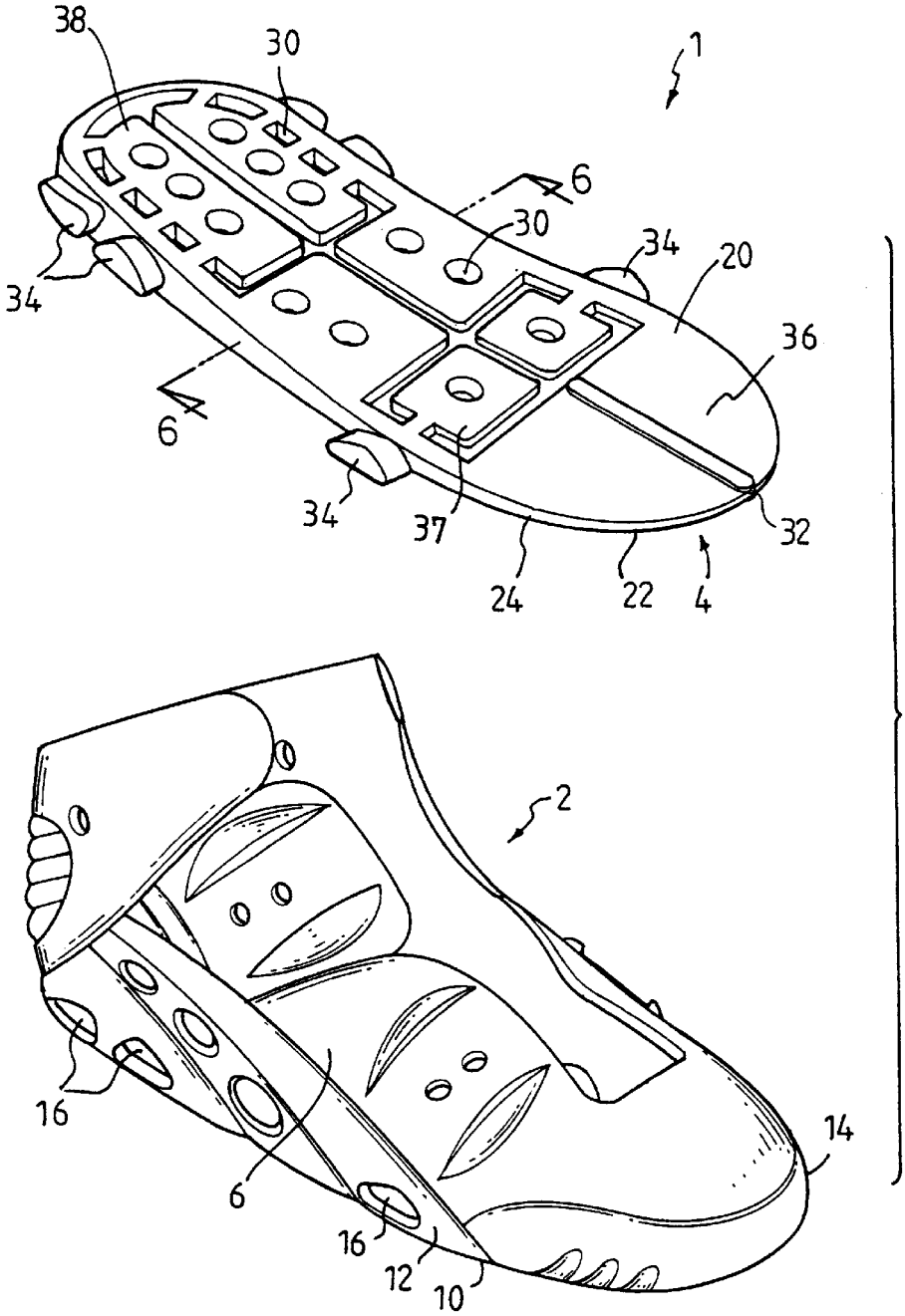
FIG. 4 is an exploded view of a preferred embodiment of a cushioned in-line skate shoe in accordance with the present invention.
Figure 5:
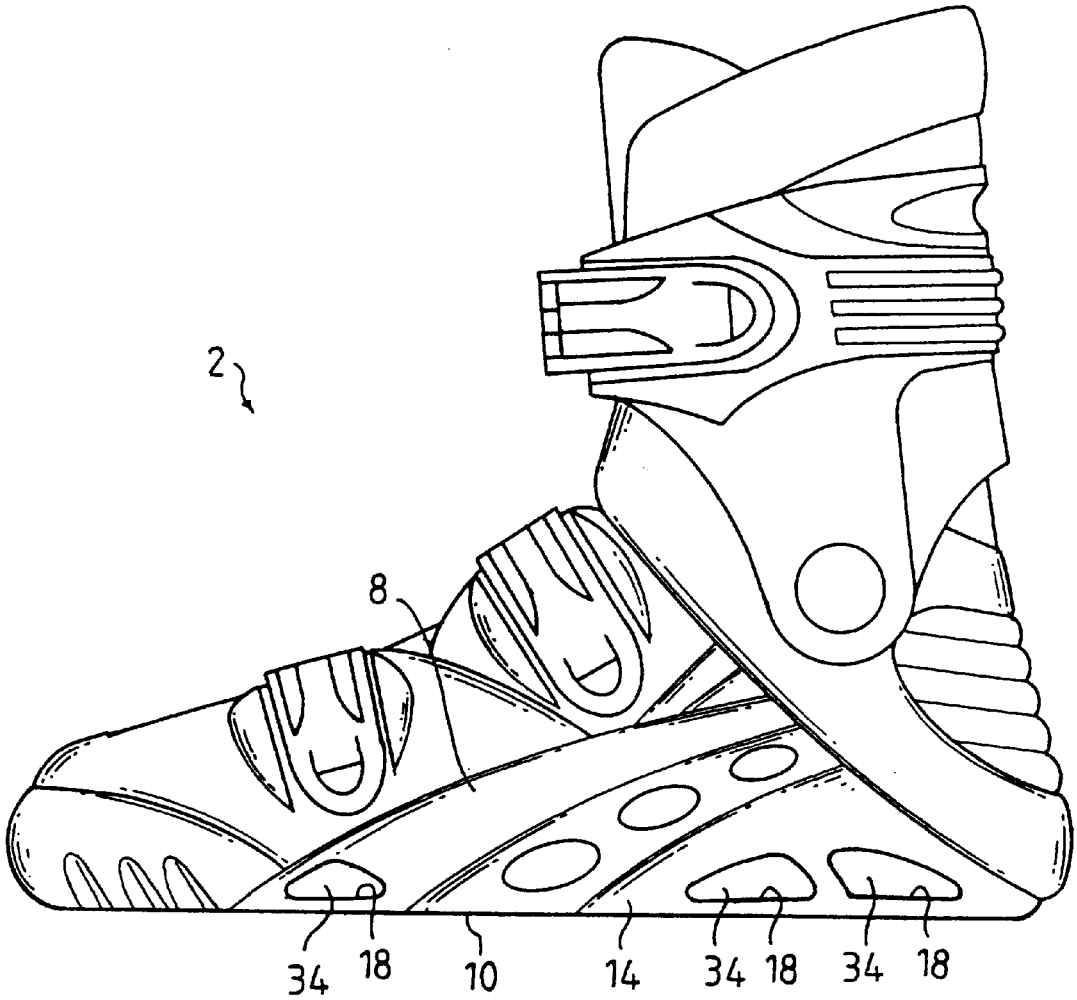
FIG. 5 is a side elevational view of a preferred embodiment of a cushioned in-line skate shoe in accordance with the present invention, showing the inner side of the in-line skate shoe body.

As shown in FIGS. 4 and 5, the cushioned in-line skate shoe 1 in accordance with the present invention comprises an in-line skate shoe body 2 and an air cushion foot pad 4. The in-line skate shoe body 2 further includes an outer side wall 6, an inner side wall 8 and a sole 10. The outer side wall 6 and the inner side wall 8 have an outer lower edge 12 and an inner lower edge 14, respectively. Further, the sole 10 is provided on a bottom of the shoe body 2 and connected between the outer and inner lower edges 12, 14.

Preferably three outer holes 16 are formed on the outer lower edge 12. Similarly, three inner holes 18 are preferably formed on the inner lower edge 14.

The air cushion foot pad 4 includes an upper surface 20, a lower surface 22 opposing to the upper surface 20, and a circumferential edge 24 formed between the upper surface 20 and the lower surface 22. The circumferential edge 24 is substantially configured to comply with the sole 10.

A plurality of flexible columns 26 connect the upper surface 20 and the lower surface 22 of the air cushion foot pad 4 to define a plurality of air chambers 28 which are formed within the circumferential edge 24 and communicate with one another so as to rigidly support the air chambers 28 against the wearer's weight and the shocks acting on the foot pad 4.

Figure 6:
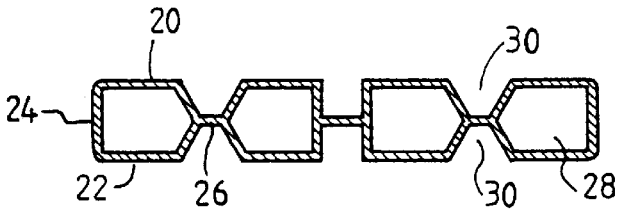
FIG. 6 is a cross sectional view taken along Line 6—6 of FIG. 4, showing the flexible columns which support and connect to the upper and lower surfaces of the foot pad.

Preferably, the air cushion foot pad 4 further comprises a plurality of recesses 30 formed on the upper surface 20 and the lower surface 22 of the foot pad 4, as shown in FIGS. 4 and 6.

Further, as shown in FIG. 4, the foot pad 4 further comprises at least one ventilating hole 32 formed on the circumferential edge 24 of the foot pad 4 and communicating with at least one of the air chambers 28. The provision of the ventilating hole 32 enables air within the air chambers 28 to flow out while the foot pad 4 is under pressure. In addition, since the ventilating hole 32 commnunicates with at least one of the air chambers 28 which further communicate with one another, the free flow of air into or out of the foot pad 4 makes the foot pad 4 be deformed properly and sustain different wearers' weights.

The foot pad 4 longitudinally comprises a toe portion 36 and a heel portion 38. The toe portion 36 further comprises a ball portion 37. The toe portion 36 is thinner than the heel portion 38 so as to form a forward inclined configuration.

Furthermore, since the wearer's weight primarily acts on the ball portion 37 and the heel portion 38, the flexible columns 26 and the air chambers 28 at the portions 37, 38 are arranged more condense than those at the other area of the foot pad 4 such that the weight of the body acting on the foot pad 4 will be dispersed on the flexible columns 26 and the air chambers 28.

Figure 7:
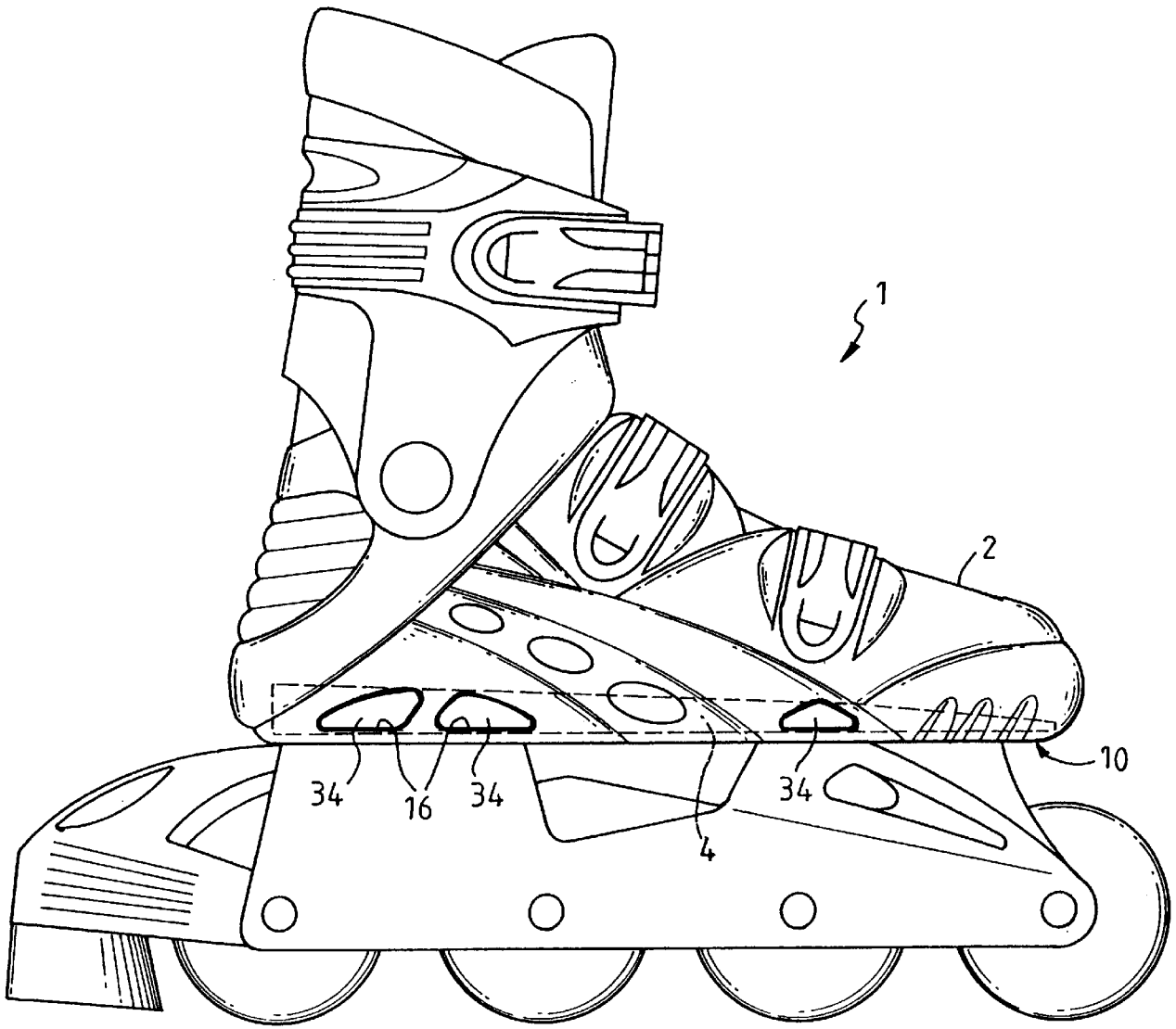
FIG. 7 is a schematic view of a preferred embodiment of a cushioned in-line skate shoe in accordance with the present invention, wherein the foot pad is illustrated in broken lines.

As shown in FIGS. 4 and 7, a plurality of transverse protrusions 34 are formed on the circumferential edge 24 of the foot pad 4. The number and location of the protrusions 34 correspond to those of the outer and inner holes 16, 18 of the shoe body 2 and there are preferably three protrusions 34 on the outer and inner lower edges 12, 14 respectively. When the foot pad 4 is positioned over and contact with the sole 10 of the shoe body 2, the protrusions 34 can be inserted into the outer and inner holes 16, 18 of the shoe body 2 to secure the foot pad 4 within the shoe body 2.

Since the flexible columns 26 connect the upper surface 20 and the lower surface 22 of the air cushion foot pad 4 so as to rigidly support the air chambers 28, the shocks can be damped and absorbed to avoid potential injury and improve comfort during roller skating. In addition, the provisions of the recesses 30 actually increase roughness on the contact area between the wearer's foot and the foot pad 4, and prevent any slipping between the foot and the foot pad 4.

Moreover, in the present invention, since the air cushion foot pad 4 is secured to the in-line skate shoe body 2 by inserting the protrusions 34 of the foot pad 4 into the outer and inner holes 16, 18 of the in-line skate shoe body 2 rather than by using an adhesive, the foot pad 4 can be replaced without difficulty.

Further, according to the present invention, the toe portion 36 is thinner than the heel portion 38 such that the air cushion foot pad 4 forms a forward inclined configuration, which allows the in-line skate 1 to utilize the foot pad 4 in an ergonomically inclined configuration without changing the shape of the in-line skate shoe body 2, as the conventional in-line skate does. Further, the foot pads' 4 inclined angles can be adjusted (namely, the thickness difference between the toe portion 36 and the heel portion 38 can be changed) such that a wearer can select the inclined angle which will give him the most comfort while wearing the in-line skates 1 and will meet all ergonomic requirements.

The above embodiment is only a preferred embodiment of the present invention. The air cushion foot pad disclosed in the above embodiment can also cover part of the sole of the in-line skate. For example, in an in-line skate designed for children, the foot pad is only provided on the heel portion of the sole.

The use of the foot pad in accordance with the present invention is not limited to in-line skates but can be used in other sport shoes such as roller skates.

The structure of the present invention is not limited to the above embodiments. Although the invention has been described with reference to the preferred embodiments, it will be obvious to those skilled in the art that various changes and modifications may be made without departing from the scope of the invention as recited in the claims.

What is claimed is:

1. A cushioned in-line skate shoe, comprising:

an in-line skate shoe body, including:

an outer side wall which has an outer lower edge;

an inner side wall which has an inner lower edge;

a sole provided on a bottom of the shoe body and connected between the outer and inner lower edges;

at least one outer hole and at least one inner hole formed on the outer lower edge and the inner lower edge, respectively;

an air cushion foot pad including:

an upper surface;

a lower surface opposing to the upper surface;

a circumferential edge which is formed between the upper and lower surfaces;

a plurality of flexible columns connecting the upper surface and the lower surface to define a plurality of air chambers formed within the circumferential edge so as to rigidly support the air chambers;

a plurality of transverse protrusions formed on the circumferential edge of the foot pad, thereby when the foot pad is positioned over and contact with the sole of the shoe body, the protrusions are inserted into the outer and inner holes of the shoe body to secure the foot pad within the shoe body.

2. The cushioned in-line skate shoe according to claim 1, wherein the foot pad comprises a toe portion and a heel portion, in which the toe portion is thinner than the heel portion.

3. The cushioned in-line skate shoe according to claim 1, wherein the foot pad further comprises a plurality of recesses formed on the upper surface and the lower surface of the foot pad.

4. The cushioned in-line skate shoe according to claim 1, wherein the foot pad further comprises at least one ventilating hole formed on the circumferential edge of the foot pad and communicating with at least one of the air chamber.

5. The cushioned in-line skate shoe according to claim 2, wherein the toe portion further comprises a ball portion, and the flexible columns and the air chambers at the ball portion and the heel portion are arranged more condense.

* * * * *